US009682798B2

(12) United States Patent
Weissbrod

(10) Patent No.: US 9,682,798 B2
(45) Date of Patent: Jun. 20, 2017

(54) WELDING CONSUMABLE CONTAINER WITH PROTECTIVE OPEN RIM

(71) Applicant: LINCOLN GLOBAL, INC., City of Industry, CA (US)

(72) Inventor: Paul A. Weissbrod, South Euclid, OH (US)

(73) Assignee: Lincoln Global, Inc., Santa Fe Springs, CA (US)

( * ) Notice: Subject to any disclaimer, the term of this patent is extended or adjusted under 35 U.S.C. 154(b) by 229 days.

(21) Appl. No.: 14/551,190

(22) Filed: Nov. 24, 2014

(65) Prior Publication Data

US 2015/0232228 A1 Aug. 20, 2015

Related U.S. Application Data

(60) Provisional application No. 61/940,599, filed on Feb. 17, 2014.

(51) Int. Cl.

| | |
|---|---|
| ***B65D 17/32*** | (2006.01) |
| ***B65D 17/00*** | (2006.01) |
| ***B65D 25/20*** | (2006.01) |
| ***B65D 85/00*** | (2006.01) |

(52) U.S. Cl.

CPC ..... *B65D 17/165* (2013.01); *B65D 17/24* (2013.01); *B65D 25/205* (2013.01); *B65D 85/70* (2013.01)

(58) Field of Classification Search

CPC .... B65D 17/163; B65D 17/04; B65D 17/165; B65D 17/24; B65D 25/205; B65D 85/70; B65D 85/26; B65D 2517/5048; B65D 2517/0061; B65D 2517/0071; B65D 2517/0016

USPC ..... 220/268, 270, 266, 273, 269, 265; 206/443

See application file for complete search history.

(56) References Cited

U.S. PATENT DOCUMENTS

| | | | | |
|---|---|---|---|---|
| 3,406,866 | A * | 10/1968 | Jasper | B21D 51/383 220/270 |
| 3,501,045 | A | 3/1970 | Asmus et al. | |
| 3,628,689 | A * | 12/1971 | Rogers | B65D 17/502 220/270 |
| 2006/0042982 | A1 | 3/2006 | Goodwin, Jr. | |
| 2012/0074015 | A1 | 3/2012 | Weissbrod | |
| 2012/0158128 | A1* | 6/2012 | Gautam | A61F 2/0095 623/2.11 |

(Continued)

FOREIGN PATENT DOCUMENTS

| | | |
|---|---|---|
| WO | WO 00/47486 A1 | 11/1999 |
| WO | WO 2004/016514 A1 | 2/2004 |

(Continued)

OTHER PUBLICATIONS

International Preliminary Report on Patentability issued on PCT/IB2015/000160, mailed Aug. 23, 2016.

*Primary Examiner* — Anthony Stashick
*Assistant Examiner* — James M Van Buskirk
(74) *Attorney, Agent, or Firm* — Foley & Lardner LLP

(57) ABSTRACT

A container having a wall, where the wall includes a score line that defines a removable lid, where the score line defines the perimeter of the lid. The container lid includes a protective component extending inwardly of the perimeter of the lid and covering a sharp edge of a burr formed by removing the lid from the wall.

21 Claims, 4 Drawing Sheets

(56) References Cited

U.S. PATENT DOCUMENTS

2013/0118042 A1* 5/2013 Keys ..... G09F 3/00
40/299.01

FOREIGN PATENT DOCUMENTS

WO WO 2005/009850 A1 2/2005
WO WO 2009/112908 A1 2/2009

* cited by examiner

WELDING CONSUMABLE CONTAINER WITH PROTECTIVE OPEN RIM

CROSS-REFERENCE TO RELATED APPLICATION AND INCORPORATION BY REFERENCE

This U.S. patent application claims the benefit of U.S. non-provisional patent application No. 61/940,599 filed on Feb. 17, 2014, which is incorporated herein by reference in its entirety.

TECHNICAL FIELD

The invention generally relates to a container for welding consumables. More particularly, the invention relates to the container lid of a container holding welding consumables having a protective lip that covers the sharp edge formed by removing an easy open portion of the container lid.

BACKGROUND OF THE INVENTION

Over the past decades, welding has become a dominant process in fabricating industrial and commercial products. Applications for welding are wide-spread and used throughout the world. Welding is used in the construction of ships, buildings, vehicles, pipelines, and also repairing or modifying existing products. Among the various methods of joining metal components, arc welding is one well known and common practice. Arc welding may employ a consumable component including but not limited to a welding rod, welding wire, electrodes, powders, flux materials and the like. These consumables may be provided in various containers for bulk and individual shipment. Given the variety of materials shipped, these containers come in many shapes and sizes. Often, the containers are provided with an easy to open disposable lid. These lids typically involve tearing a thin web of material at the perimeter of the lid. To assist in tearing the material, a pull tab or other device may be provided to initiate the tear or facilitate tearing of the thin web.

As a result of tearing the thin web, a sharp burr is formed at the edge of the opening. This edge may be a source of injury or damage to the user's clothing or the contents of the container as they are removed. To provide the thin web of material, a score is cut partway through the steel or aluminum sheet forming the wall of the container in which the lid if formed. In addition to the safety issue created by the burr formed when opening the lid, in the food industry, the groove formed by the score is viewed as a possible location for the entrapment of contaminants that may lead to food spoiling within the container. To that end, in the food industry, the score is always provided on the outside of the can so that an uninterrupted surface faces the food within the container. The resulting burr formed when opening a food container, consequently, will be located on the inside edge of the opening. To that end, in the food industry, a rolled steel edge is applied about the opening to attempt to cover the burr and deflect contact away from the burr before a user's hand or garment comes in contact with the burr. This edge is sometimes referred to as a safety edge. Nevertheless, forming the score line beneath the rolled edge is difficult and the resulting burr still extends inward such that the sharp edge is exposed to the interior of the container. Therefore, the risk that a user withdrawing their hand from the container could still contact the sharp edge of the burr.

In view of this, it is desirable to provide a container that further reduces the risk of injury or damage to objects being withdrawn from the lid of the container resulting from the burr formed by the opening of a lid that is torn from the wall of a container.

SUMMARY OF THE INVENTION

The present invention generally provides a container having a wall, where the wall includes a score line that defines a removable lid, where the score line defines the perimeter of the lid. The container lid includes a protective element extending inwardly of the perimeter of the lid and covering a sharp edge of a burr formed by removing the lid from the wall.

The invention further includes a container including at least one side wall that defines a volume for receiving at least one welding consumable; an end wall attached to the at least one sidewall, an end wall connected to the at least one sidewall, the end wall enclosing the at least one welding consumable within the volume, the end wall including an inner surface and an outer surface; an inverted score line formed in the inner surface of the end wall defining a perimeter of a container lid, wherein the container lid is removable from the end wall by tearing the container lid along the inverted score line, wherein the inverted score line forms an upward facing burr upon tearing; and a protective element attached to a surface of the end wall, the protective extending inward relative to the at least one sidewall to cover the upward facing burr.

In accordance with another aspect of the invention, the protective cover includes a label provided on the wall, where the label includes a label score line located inward of the lid score line. In accordance with another aspect of the invention, the label is applied to a surface of the wall opposite to the surface in which the lid score line is formed. For example, if the lid score line is formed in the interior surface of the wall, the label may be applied to the exterior surface of the wall. When the lid score line is formed in an exterior surface of the wall, the label is applied an interior surface of the wall. According to another aspect of the invention, the protective cover is formed by a folded or rolled portion of the wall, where the lid score line is formed in an interior surface of the wall and the folded or rolled portion extends inward of the lid score line over an exterior surface of the wall so that the burr formed when the lid is removed is located under the folded portion and the sharp edge of the burr extends upward into the folded portion.

The present invention further provides container lid for a container having at least one side wall that defines a volume for receiving welding consumables, the container lid including an end wall that is supported on the at least one side wall and closes the volume, the end wall including a first score line defining a perimeter of the container lid within the end wall, wherein the first score line is formed one of the inner and outer surface of the end wall and a label is applied to the opposite surface of the end wall relative to the score line, the label defining a second score line located radially inward relative to the first score line, wherein the container lid is removable from the end wall by tearing the end wall along the first score line, and upon removal of the container lid, the label tears along the second score line, the label forming a protective lip.

The present invention further provides a container comprising at least one side wall defining a volume and an end cap attached to the side wall to enclose the volume, wherein the end cap includes a first score line formed in one surface of the end wall, the first score line defining a removable container lid; a label attached to an opposite surface of the end wall, the label covering the container lid and extending outward of the first score line; and wherein the label defines a second score line located radially inward of the first score line.

The invention further provides a container including a wall defining an enclosed volume, wherein the wall includes an inner surface and an outer surface; a first score line formed in the inner surface of the wall, the score line defining a perimeter of a removable container lid; a label attached to the wall covering the container lid and extending outward of the score line; and wherein the label defines a second score line located inward of the first score line, wherein removal of the container lid tears the label along the second score line leaving a portion of the label attached to the wall and extending inward of the edge of the end wall to form a protective element.

The present invention also provides a welding consumable container including at least one side wall defining a volume adapted to receive the welding consumable, an end wall attached to the side wall by a rolled edge, a score line formed on an inner surface of the end wall beneath the rolled edge.

The invention further provides a container including at least one side wall defining a volume; a welding consumable received within the volume of the container, an end wall attached to the side wall by a rolled edge to enclose the welding consumable within the volume, the rolled edge defining a first bend that extends radially inward from the side wall forming an inward extremity; a first score line formed on an inner surface of the end wall, the first score line having a cross-sectional profile that tapers inward as it extends outward from the inner surface of the end wall; wherein the first score line defines a perimeter of a removable container lid, the first score line being located radially outward of the inward extremity of the rolled edge, such that when the container lid is removed from the end wall a portion of the end wall remains radially outward of the inward extremity of the rolled edge; wherein removal of the container lid forms an edge at the end wall, the edge defining an opening through which the welding consumable is accessed; and a label attached to the end wall covering the container lid and extending outward of the perimeter of the container lid, a second score line formed in the label inward of the first score line; wherein removal of the container lid tears the label along the second score line leaving a portion of the label attached to the end portion and extending inward over a portion of the opening to form a protective element that extends inward of the edge of the end wall.

DETAILED DESCRIPTION OF THE INVENTION

Figure 1:
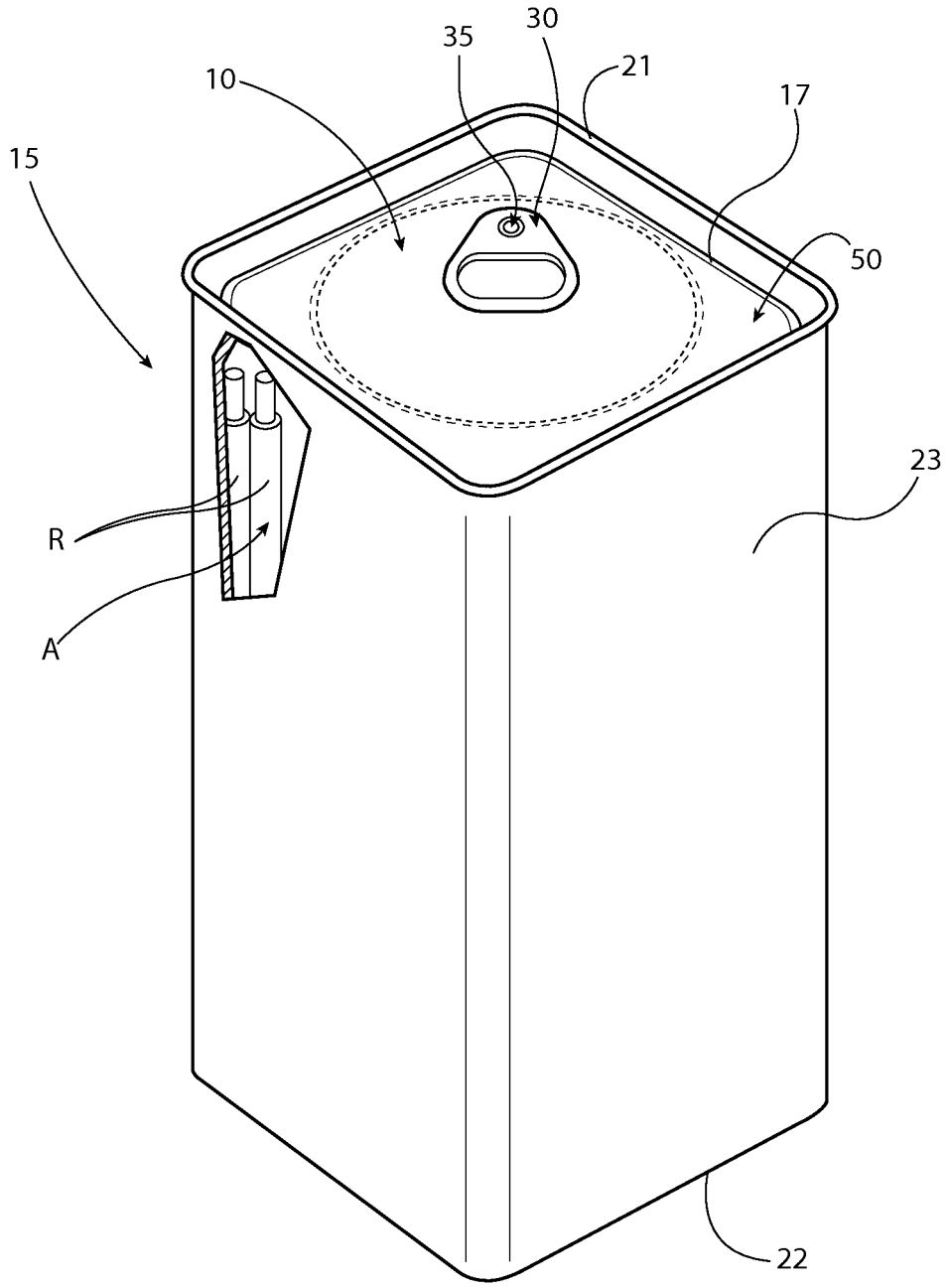
FIG. 1 is a perspective view of a container having a container lid according to the invention.

A container lid according to the concepts of the invention is generally indicated by the number 10 in the accompanying drawings. Container lid 10 may be provided on any type of container. In the example discussed herein, the container lid 10 is provided on a container 15 used to transport welding consumables. The container 15 may be constructed from a durable yet relatively thin sheet of material. As discussed more completely below, a variety of materials may be used including but not limited to metals, plastics, wood, or other pulp material including paper, cardboard, and the like. The components of the container need not be formed of the same material. For example, a wall of the container may be constructed of one material and the lid constructed of a second material.

The container 15 may have various shapes, cross-sections or configurations based on the type of material or other considerations affecting the exterior shape of the container including stackability, transportability, and ornamental appearance. As a result, the examples provided herein are not limiting. In the example shown, the container 15 includes a square cross-sectioned tube closed at each end by an end wall 17. In the example shown, the container lid 10 according to the invention is provided within one of the end walls 17 to provide easy access to the contents of the container. It will be appreciated that the container lid 10 may be formed in any of the walls of the container including, for example, the front wall, side walls, or opposite end of the container shown. Other container configurations may provide additional walls in which the container lid may be provided. As a results, the example shown should not be considered limiting.

Container 15 may be constructed of any material suitable for the materials to be stored within and with attention to the transport and other environmental factors that the container will face. The container may be generally rigid or semi-rigid and may have a fixed volume or expanding collapsed to vary the volume. In the example shown, the container 10 is a tubular member constructed from aluminum, however, it will be understood that other materials including but not limited to other metals, metal alloys, plastics, fiber reinforced products, paper, cardboard or other pulp material based products, wood, glass, ceramics, and combinations thereof may be used.

In the example shown, container 15 is used to contain rod-like articles A, such as, for example, welding rods R. As previously discussed, the type of articles A contained by container 15 may be any welding consumable or material. Moreover, the container lid 10 of the invention may be used in connection with containers for other industrial applications as well.

Container 15 may have a first end 21 and a second end 22, first end 21 and second end 22 may be capped to define an enclosed volume, generally indicated by the number 25, in which articles A are stored. When capped, first end and second end may be sealed to further protect the contents of the container from ambient conditions that may be detrimental to the contents of the container 15. For example, some welding consumables are prone to oxidation or hydrophilic such that, the water vapor contained in ambient air becomes a contaminant due to the increase in hydrogen content in the weld. Other airborne contaminants including but not limited to, dust, metals, gases, shavings and the like may also be a concern that would support sealing the caps of the container to the container side wall 23. It will be understood, that not every application will require that the container 15 be sealed.

Figure 3:
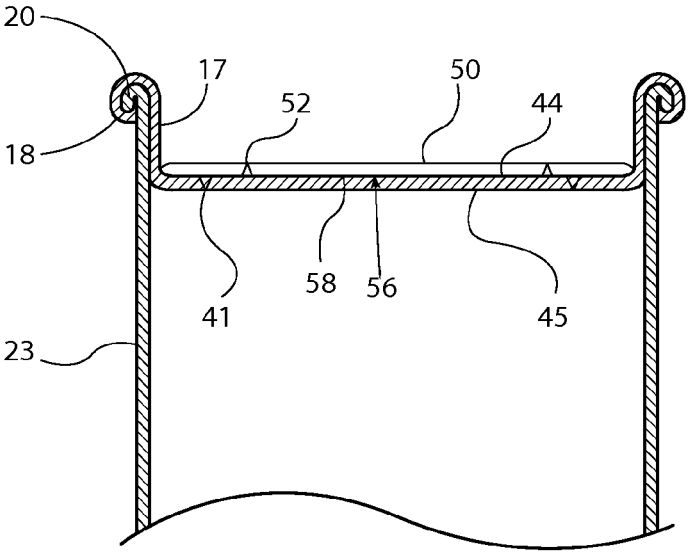
FIG. 3 is a sectional view as might be seen along line 3-3 in FIG. 2.

The container lid 10 may be formed from the same types of materials as the container 15. The container lid 10 may be the same material as the container or a different material. The container lid 10 may be formed in the same process as container 15 or, as shown, container lid 10 may be attached to container 15. With reference to FIG. 3, to receive the end wall 17 in which container lid 10 is formed, the container 15 may include a rolled lip 20 to which the perimeter 18 of end wall 17 is crimped when affixing the end wall 17 to the rectangular tube. Such attachment may be used to create an air tight seal.

Figure 2:
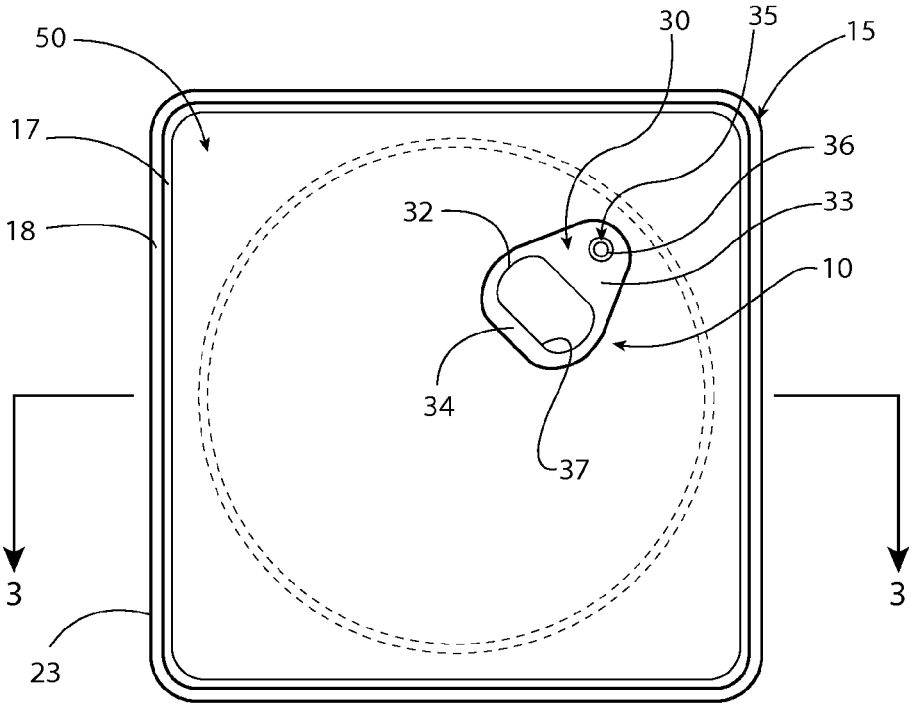
FIG. 2 is top view thereof.

With reference to FIGS. 2 and 3, container lid 10 may be provided with a handle 30 to facilitate opening of the container lid 10. Handle 30 may be any member or article that can be grasped by the user to pull the lid 10 from the container or provides leverage to pry the lid 10 from end wall 17 including but not limited to the pull tab 32 shown. In the embodiments of the invention, the lid 10 is formed as part of end wall 17 by scoring end wall 17 to define the removable lid 10 that is torn away or peeled back to access the contents of container 15. Pull tab 32 may be attached to lid by a fastener 35 including but not limited to a weld, an adhesive, a rivet, a bolt, a clip, a clasp, or other device used to attach articles to a sheet of material. In the example shown, a rivet 36 attaches a pull tab 32 at a forward portion 33 located near one edge of container lid 10. A rearward portion 34 of pull tab 32 extends radially inward from forward portion 33 and defines a graspable surface for the user. In the example shown, rearward portion 34 is wider than forward portion 33 and defines a pull opening 37 that the user may use to lift the tab 32 away from the end wall 17 and pull on tab 32 to tear the lid 10 from end wall 17.

To facilitate removal of the lid 10, a first score line 41 is formed in the end wall 17. First score line 41 may be formed in any known manner and generally results in a reduction in the thickness of the end wall material, which facilitates removal of container lid 10. The first score line is shown as having a cross-section that tapers inward as it extends into the surface of the end wall. For example, first score line may have a triangular cross-section in FIG. 3, but other cross sections may be used to similar effect including but not limited to a cross-section that has a rounded or square shape. The score lines shown in the embodiments discussed herein are exaggerated for purposes of illustration and are not drawn to actual scale. The first score line 41 forms a perimeter 43 of lid 10 as it is torn away from end wall 17. The perimeter 43 formed by score line may have any shape including but not limited to rectangular, square, oval, polygon, or a circular shape, as shown.

Figure 4:
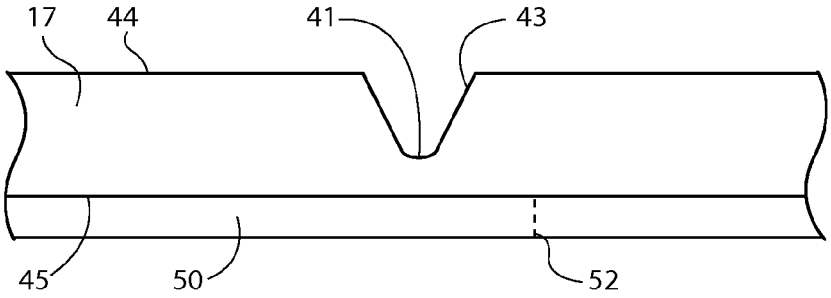
FIG. 4 is an enlarged partially schematic sectional view of a lid according to one embodiment of the invention.
Figure 5:
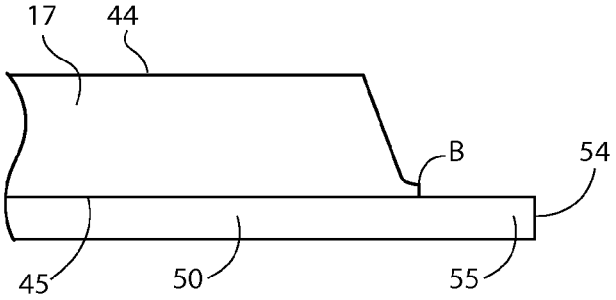
FIG. 5 is an enlarged partially schematic sectional view similar to FIG. 4 shown with the lid torn away from the container.

With reference to FIGS. 4 and 5, according to one embodiment of the invention, first score line 41 is formed in an outer surface 44 of end wall 17. When the lid 10 is removed, torn portion of the end wall 17 typically forms a burr B or other sharp edge. A label, generally indicated by the number 50, is provided on the opposite side of end wall 17 relative to first score line 41. As described below, according to the invention label 50 is used to form a protective element that covers burr B relative to the user to prevent the burr from injuring the user when reaching through the opening formed by removing lid 10. The term label is used to describe any layer of material that is placed on a surface of the container to cover the burr as described more completely below. Reference to the term label should not, therefore, be construed as limiting the layer of material to a layer that includes printed material on it. While that is true in the example shown, layer may also be devoid of printed material and in some cases may be transparent. To that end, label, as used herein, may be any layer of material including coatings, films, and the like. Suitable materials include but are not limited to flexible films including paper, thin polymer films, such as, spunbonded olefins including but not limited to olefins formed from polyethylene or polyester, and vinyl or combinations thereof. High density spunbonded olefin materials such as Scotchpak™ from 3M or Tyvek® from DuPont are suitable. In the example shown, a multi-layer laminate structure including a polyester top layer, paper intermediate layer and adhesive bottom layer is used to form label 50. It was found that the multi-layer structure was beneficial in combining properties of materials including the ability of the paper layer to provide body to the label. The polyester layer provided formability and consistent application of the label as well as some protection for the underlying paper layer. The material also provided a platform for printing or otherwising marking the label allowing the label to carry decorative and/or communicative elements including but not limited to logos, patterns, instructions, information about the contents, and the like.

Label 50 may be attached to a surface of container in any known manner including with an adhesive, weld, shrink fit or other bond, generally indicated at 56, located or formed on an inward facing surface 58 of label 50. In the example shown, a layer of adhesive forms bond 56 across the entire surface of the label. It will be understood that this may include a pattern of adhesive over the surface of the label to form the bond across the entire surface or the layer of adhesive may include a continuous coating of adhesive. Alternatively, adhesive may be applied at the margin of the label located outward of a second score line 52 described more completely below.

In the example shown in FIGS. 4 and 5, label 50 is located on an inner surface 45 of end wall 17. A second score line 52 is formed in label to define a perimeter 54 about which the label 50 tears away when the lid 10 is removed. Second score line 52 may be formed in any manner appropriate for the label material including but not limited to a continuous score line or a score line formed by a series of indentations or perforations that act to weaken the label and cause it to break away at the score line 52. As best seen in FIGS. 2 and 3, second score line 52 is located inward of first score line 41 such that the portion of label 50 that remains on end wall 17 extends inward of the opening formed when the lid is removed. The portion of the label extending inward of the edge of the torn edge of container forms a protective lip 55 that covers burr B.

Figure 6:
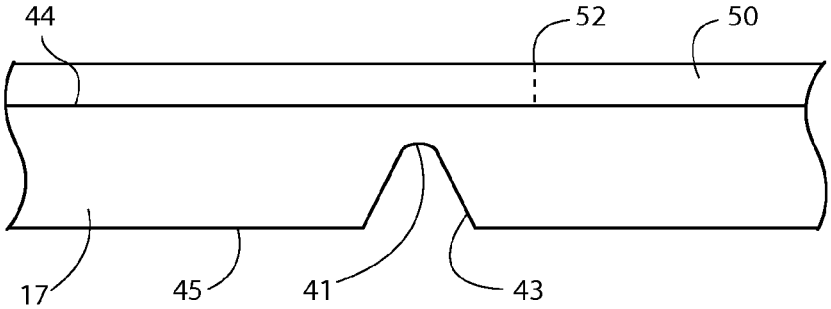
FIG. 6 is an enlarged partially schematic sectional view of a lid according to another embodiment of the invention.
Figure 7:
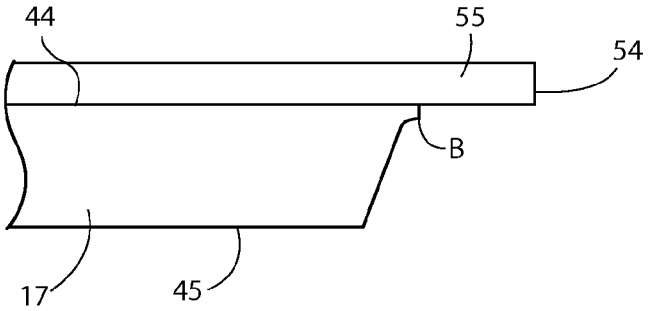
FIG. 7 is an enlarged partially schematic sectional view similar to FIG. 6 shown with the lid torn away from the container.

With reference to FIGS. 6 and 7, the first score line 41 is formed on inner surface 45 of end wall 17 and label 50 is located on outer surface 44 of end wall 17. As in the previous embodiment, second score line 52 is formed inward of first score line 41, such that, label 50 provides a protective lip 55 that covers burr B. While reference is made to the end wall for placement of the removable lid 10 and label 50, it will be understood that these may be formed or placed on any wall of container.

Figure 8:
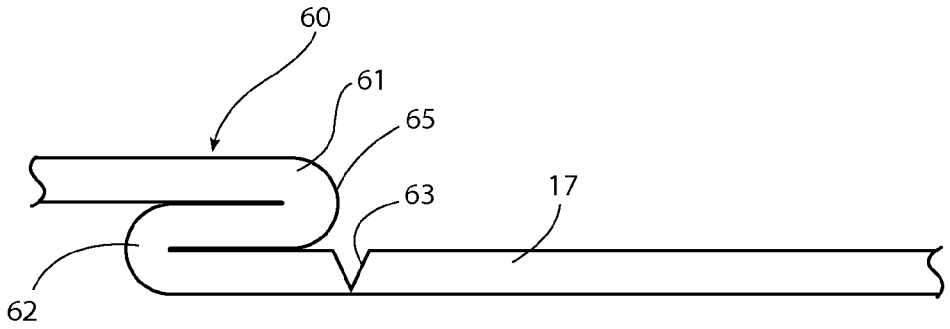
FIG. 8 (PRIOR ART)
FIG. 8. is an enlarged partially schematic sectional view of a Safety Lid.
Figure 9:
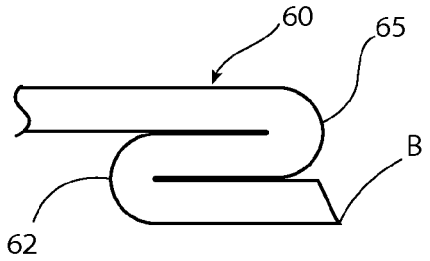
FIG. 9 (PRIOR ART)
FIG. 9 is an enlarged partially schematic sectional view similar to FIG. 8 with the lid torn away.

FIGS. 8 and 9 show the cross section of a Safety lid used in the food canning industry. The Safety lid includes a rolled edge, generally indicated at 60. As shown, rolled edge 60 may be formed as part of the end wall 17 of the container, where the end wall 17 includes extends radially inward from the side of container and then bends downward and turns outward to form a first bend 61. A second bend 62 is formed by the end wall extending downward and turning outward beneath the first bend 61 before extending across the mouth of the container. The first bend 61 of rolled edge, thus, forms a blunt inward facing edge or inward extremity 65 that helps protect the user from a burr B as discussed more completely below.

In the food canning industry, the score line 63 that forms the lid 10 must be placed on the outer surface 44 of the container. On the inner surface, score line becomes an area where bacteria or other contaminants may gather, and therefore, in that industry is unacceptable. As a result, the score line is on the outer surface causing an inward facing burr B at the inner surface of end wall 17. To improve safety, score line 63 is placed as close as possible to the rolled edge 60 so that the rolled edge helps shield the burr B by forcing the user to reach inward of the rolled edge 60. Nevertheless since the score line must be located inward of the rolled edge 60 to form it in the outer surface 44 of end wall 17, the burr B extends inward of rolled edge 60 and, therefore, still presents a risk.

Figure 10:
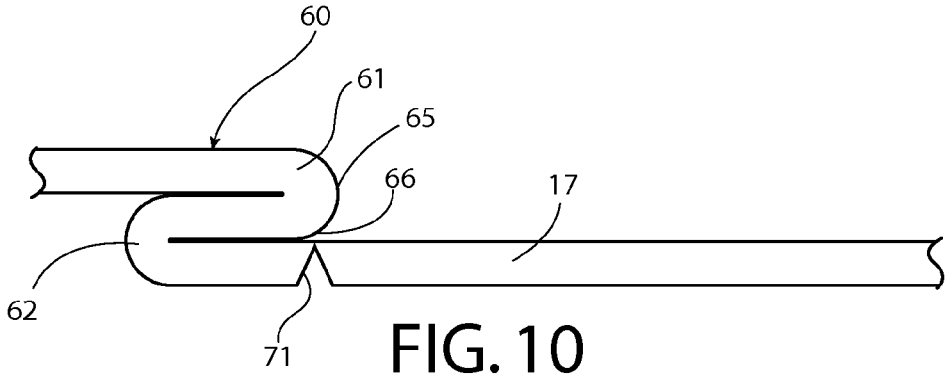
FIG. 10 is an enlarged partially schematic sectional view of a lid according to another embodiment of the invention
Figure 11:
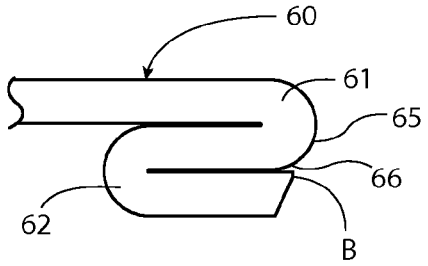
FIG. 11 is an enlarged partially schematic sectional view similar to FIG. 10 shown with the lid torn away from the container.

According to the invention, as shown in FIGS. 10 and 11, lid 10 is formed by a first score line 71 is formed on an inner surface 45 of end wall 17. The first score line 71 may have any cross-section appropriate for facilitating removal of container lid 10. In the example shown, first score line 71 has a cross-section that tapers inward as it extends inward from the surface in which it is formed. In the example shown, cross section of first score line 71 has a generally triangular shape. When lid 10 is torn away, burr B is located at the outer surface 44 of end wall 17. Score line 71 is located outward of the radial inward extremity 65 of rolled edge 60. Consequently, burr B lies underneath rolled edge 60. As best shown in FIG. 11, the overhang 66 created by rolled edge's radial inward extension relative to the torn edge 48 of end wall 17 shields the burr B.

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (e.g., enclosures, sides, components, assemblies, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described above with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

The invention claimed is:

1. A container lid comprising:

at least one side wall that defines a volume for receiving at least one welding consumable;

an end wall connected to the at least one sidewall, the end wall enclosing the at least one welding consumable within the volume;

a score line formed in a surface of the end wall defining a perimeter of a container lid, wherein at least a portion of the container lid is removable from the end wall by tearing the container lid along the score line, and wherein the score line forms a burr upon tearing; and a protective element attached to a surface of the end wall, the protective element extending inward relative to the at least one sidewall to cover the burr, and wherein the protective element comprises a label on the end wall, the label covering the container lid and extending radially outward of the perimeter of the container lid to attach to the end wall outside of the container lid, the label defining a second score line located radially inward relative to the first score line, wherein the label tears along the second score line leaving a flexible lip extending inward of the first score line to cover the burr.

2. The container lid of claim 1, wherein the second score line is formed continuously.

3. The container lid of claims 1, wherein the label is attached to the end wall with an adhesive.

4. The container lid of claim 1, wherein the label is made from a high density spunbonded olefin film.

5. The container lid of claim 1, wherein the label is made from a laminate structure including a paper layer and a polyester layer.

6. The container lid of claim 1 further comprising a handle attached to the end wall.

7. The container lid of claim 6, wherein the handle is a pull tab.

8. The container lid of claim 1 wherein the protective element includes a rolled edge formed at a perimeter of the wall.

9. The container lid of claim 1, wherein the label is on an opposite surface of the end wall relative to the surface of the end wall in which the score line is formed.

10. The container lid of claim 1, wherein the end wall includes an inner surface and an outer surface, wherein the score line is formed in the outer surface of the end wall, and wherein the label is applied to the inner surface of the end wall.

11. A container comprising:

a wall defining an enclosed volume;

a first score line formed in a surface of the wall, the score line defining a perimeter of a removable container lid;

a label attached to the wall covering the container lid and extending outward of the score line; and wherein the label defines a second score line located inward of the first score line, wherein removal of the container lid tears the label along the second score line leaving a portion of the label attached to the wall and extending inward of the edge of the end wall to form a protective element.

12. The container of claim 11, wherein the wall includes a sidewall and an end wall that are attached to each other to form the enclosed volume; wherein the first score line is formed in an outer surface of the end wall and the label is attached to an inner surface of the end wall.

13. The container of claim 12, wherein the second score line is formed on an outer surface of the label.

14. The container of claim 12, wherein the end wall is sealingly attached to the at least one side wall to seal the volume.

15. The container of claim 11, wherein the label is made from flexible film.

16. The container of claim 11, wherein the label is made a high density spunbonded olefin film.

17. The container of claim 11 further comprising a handle attached to the container lid.

18. The container of claim 17, wherein the handle is a pull tab.

19. The container of claim 11, wherein the label is attached with a layer of adhesive.

20. The container of claim 11, wherein the first and second score line are continuous.

21. A container comprising:

at least one side wall defining a volume;

a welding consumable received within the volume of the container, an end wall attached to the side wall by a rolled edge to enclose the welding consumable within the volume, the rolled edge defining a first bend that extends radially inward from the side wall forming an inward extremity;

a first score line formed on an inner surface of the end wall, the first score line having a cross-sectional profile that tapers inward as it extends outward from the inner surface of the end wall;

wherein the first score line defines a perimeter of a removable container lid, the first score line being located radially outward of the inward extremity of the rolled edge, such that when the container lid is removed from the end wall a portion of the end wall remains radially outward of the inward extremity of the rolled edge; wherein removal of the container lid forms an edge at the end wall, the edge defining an opening through which the welding consumable is accessed; and a label attached to the end wall covering the container lid and extending outward of the perimeter of the container lid, a second score line formed in the label inward of the first score line; wherein removal of the container lid tears the label along the second score line leaving a portion of the label attached to the end portion and extending inward over a portion of the opening to form a protective element that extends inward of the edge of the end wall.

* * * * *